United States Patent [19]

Berger et al.

[11] B 4,013,121

[45] Mar. 22, 1977

[54] STEAM GENERATOR, TUBE-BUNDLE CENTERING ARRANGEMENT

[75] Inventors: Wolfgang Berger, Erlangen; Hans Röttger, Weiher, both of Germany

[73] Assignee: Siemens Aktiengesellschaft, Munich, Germany

[22] Filed: July 15, 1974

[21] Appl. No.: 488,836

[44] Published under the second Trial Voluntary Protest Program on March 30, 1976 as document No. B 488,836.

[30] Foreign Application Priority Data

July 25, 1973 Germany ..... 2337791

[52] U.S. Cl. ..... 165/162

[51] Int. Cl.[2] ..... F28F 9/00

[58] Field of Search ..... 165/78, 162; 122/510

[56] References Cited

UNITED STATES PATENTS

| | | | |
|---|---|---|---|
| 2,477,950 | 8/1949 | Bailey | 165/162 X |
| 3,420,297 | 1/1969 | Romanos | 165/162 |
| 3,677,339 | 7/1972 | Perrin et al. | 165/162 |

*Primary Examiner*—Charles J. Myhre
*Assistant Examiner*—Theophil W. Streule, Jr.
*Attorney, Agent, or Firm*—Kenyon & Kenyon Reilly Carr & Chapin

[57] ABSTRACT

A steam generator has an upstanding tube bundle radially enclosed by a vertical cylindrical wall, the tube bundle being centered within the wall by a tube spacer grid connected to the inside of the wall by keys and keyways which can slide vertically relative to each other, relieving the tube bundle and wall from mechanical stressing due to vertical thermal expansion and contraction causing relative vertical movement between the tube bundle and wall.

4 Claims, 5 Drawing Figures

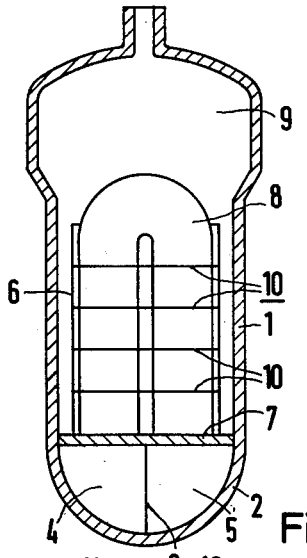
Fig.1
Fig. 4
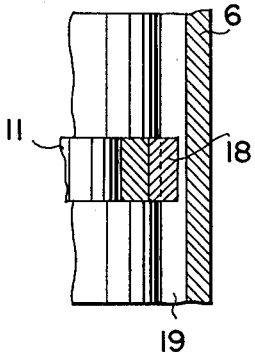
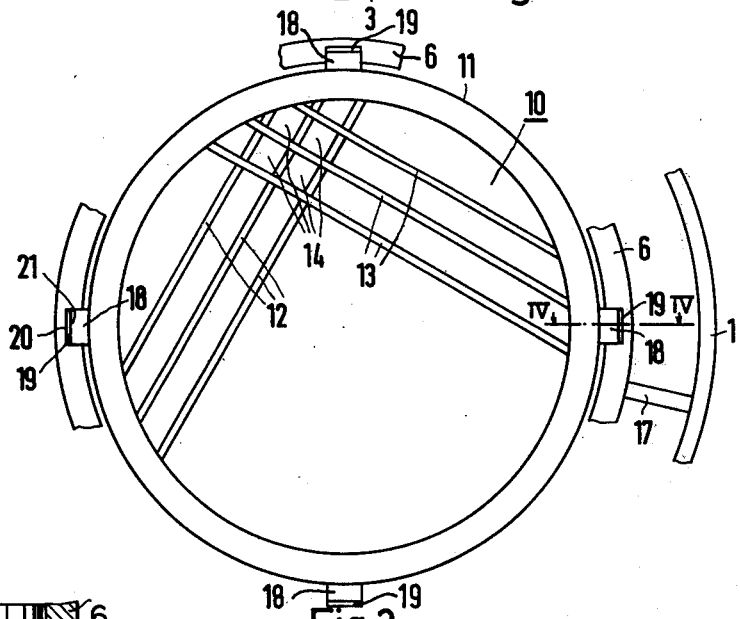
Fig.2
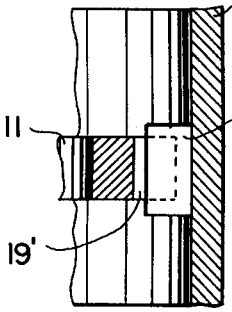
Fig. 5
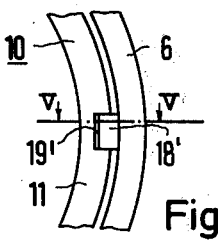
Fig.3

STEAM GENERATOR, TUBE-BUNDLE CENTERING ARRANGEMENT

BACKGROUND OF THE INVENTION

This invention relates to the type of steam generator having a tube sheet, a heat-exchanger tube bundle formed by a plurality of interspaced tubes having ends mounted in the tube sheet and extending therefrom and a cylindrical wall which surrounds the tube bundle. To hold the tube bundle centered inside of the cylindrical wall, one or more tube spacer grids are used each formed by a ring encircling the tube bundle inside of the cylindrical wall, the ring mounting criss-crossed bars forming openings through which the tube bundle's individual tubes extend, and the ring being connected to the inside of the cylindrical wall to in this way hold the tube bundle centered within the wall.

The above is exemplified by the typical pressurized-water reactor steam generator. In this case the cylindrical wall is formed by the shroud within the vertical steam generator housing which has its bottom end closed by the horizontal tube sheet with the tube bundle being of inverted U-shape with the bottom ends of its tube legs mounted in the tube sheet. Inlet and outlet manifolds connect the inlet and outlet legs of the tube bundle with the main coolant loop of the reactor, and the vertical housing has a feed-water inlet, its top being provided with a steam dome having a steam output outlet. The shroud encircles the tube bundle and is spaced inside of the housing to form therebetween the descent space, the feed-water rising inside of the shroud and descending via this descent space to maintain a circulation within the steam generator housing. In this case the tube bundle should be held centered within the cylindrical shroud.

The individual tubes are held in their interspaced relationship by a spacer grid formed by criss-crossed bars forming openings through which the individual tubes extend, the ends of the bars being mounted by a ring encircling the tube bundle and which is connected to the inside of the cylindrical wall surrounding the tube bundle to hold the latter centered within the cylindrical wall.

When the operating temperature of the steam generator changes, thermal expansion and contraction causes relative movement between the tube bundle and wall surrounding this tube bundle. In the case of a pressurized-water reactor steam generator typically having a vertical tube bundle surrounded by a vertical shroud with vertical dimensions in the area of 10 m, and which between cold and hot conditions involve temperature differences of around 300°C., the tube bundle can receive substantial mechanical stress when the spacer grid is fixed to the shroud; and since the tube bundle tubes are of relatively small diameter as compared to their length, this has been a problem. Any steam generator having a tube bundle surrounded by a cylindrical wall with the tube bundle centered within the wall in substantially the same manner, involves the same problem.

SUMMARY OF THE INVENTION

The object of the present invention is to solve the above problem. According to this invention, the problem is solved by connecting the spacer grid with the cylindrical wall that surrounds the tube bundle, by keys and keyways which permit sliding movement longitudinally with respect to the tube bundle and its surrounding wall, so that the tube bundle and its surrounding wall are freed from mechanical stress due to the relative thermal movement that occurs between the tube bundle and the surrounding wall. At the same time, the connection of the spacer grid ring to the inside of the cylindrical wall locks the ring against movement circumferentially with respect to the wall, so by using three or more of the key and keyway connections between the ring and the wall, the tube bundle is held accurately centered within the cylindrical wall.

Normally the steam generator uses a plurality of such spacer grids, and in accordance with the present invention, each of the grids is connected by the keys and keyways with the wall surrounding the tube bundle. The keys may be on either the ring or the wall with the keyway formed by the other of these two parts. Normally the keys and keyways would have rectangular cross-sections and the bottoms of the keyways can be spaced relative to the opposing ends of the keys to accommodate radial expansion of the spacer grid ring, without interfering with the centering function providing at least three of the connections are used.

In the case of a pressurized-water reactor steam generator, the connections are made between the rings of the various spacer grids and the inside of the shroud forming the descent space, the relative motions in this instance being vertical and radial.

BRIEF DESCRIPTION OF THE DRAWINGS

The presently preferred mode for carrying out the invention is schematically illustrated by the accompanying drawings in which:

FIG. 1 in vertical section illustrates a pressurized-water reactor steam generator;

FIG. 2 in cross section shows the key and keyway connections, the keys being fixed to the spacer grid rings with the keyways formed in the shroud, in this instance;

FIG. 3 in cross section illustrates an instance when the keys are formed on the shroud with the keyways formed in the spacer grid rings;

FIG. 4 is a vertical section taken on the line IV—IV in FIG. 2; and

FIG. 5 is a vertical section taken on the line V—V in FIG. 3.

DETAILED DESCRIPTION OF THE INVENTION

The steam generator shown by FIG. 1 has a substantially cylindrical and vertical housing 1, with the primary header 2 of hemispherical shape divided by a vertical partition 3 to form the coolant inlet and outlet manifolds 4 and 5, respectively. The cylindrical shroud 6 extends upwardly from the horizontal tube sheet 7 which mounts the bottom ends of the inlet and outlet legs of the inverted U-shaped tube bundle 8, the individual tubes of which are not shown because of their familiarity to everyone. The top of the housing 1 is radially enlarged to form the space 9 within which water separators (not shown) are usually located.

The main coolant loop connections with the manifolds 4 and 5 and the feed-water inlet are not shown, again because they are familiar. Coolant from the hot leg of the main loop enters the inlet manifold, goes through the hot leg of the tube bundle 8, returns to the bundle's cold leg and goes back to the reactor via the outlet manifold. Feed-water is introduced to the housing 1 above the tube sheet 7, partially vaporizes the steam while rising inside of the shroud 6 with the unvaporized feed water descending via the descent space between the shroud 6 and the housing 1. Although not shown, the bottom of the shroud 6 provides an opening so that the descending feed water can flow radially inwardly over the top of the tube sheet 7 to again rise inside of the shroud 6.

To center the tube bundle 8 within the vertical shroud 6, and to maintain the interspacing of the individual tubes of the tube bundle, the spacer grids 10 are used, there being a plurality of these spacer grids interspaced vertically.

Each spacer grid 10 comprises a ring 11 which encircles the tube bundle and mounting the ends of the criss-crossed bars 12 and 13 forming the openings 14 through which the individual tubes (not shown) extend. The ends of the bars may be fastened to the ring 11 in the usual manner.

The vertical cylindrical shroud 6 is centered relative to the vertical cylindrical housing 1 via a series of struts 17, so if the tube bundle 8 is centered relative to the shroud 6, it is also centered relative to the housing 1.

The previously referred to key and keyway connections are shown in FIG. 2, and the keys 18 being fixed to the ring 11 and the keyways 19 being formed inside of the shroud 6. Both the keys and keyways are rectangular in cross section and provide flat interfacing and vertical sliding surfaces permitting the relative vertical motion between the tube bundle 8 and shroud 6. At least three of these vertically slidable connections should be used, four being shown by FIG. 2. The keys and keyways are interlocked against movement circumferentially with respect to the ring 11 and the shroud 6, so the ring 11 is held positively centered relative to the shroud 6 and, therefore, relative to the cylindrical housing 1.

To accommodate radial thermal expansion and contraction motion, the bottoms 20 of the keyways and the radial ends of the keys 21, by proper proportioning of the parts, always provide some space even when the maximum radial expansion motion occurs. In this way there is no possibility for mechanical stressing in the radial direction of the ring 11 and shroud 6.

In FIG. 2 the keyways are machined into the shroud 6, whereas in FIG. 3 the keyways 19' are machined into the spacer grid rings 11, the keys 18' extending radially inwardly from the shroud 17.

The horizontally rectangular contours of the keys and keyways provide for not only vertical slidability, but also for slidability in the radial direction of the rings 11.

The described tube bundle centering action is of importance not only in connection with the operation of the steam generator, but also during its transport to the reactor site. The keys and keyways may be designed by appropriate dimension to avoid excessive frictional resistance to the sliding of the parts relative to each other without interfering with the centering function.

It is to be understood that in the normal way the spacer grids 10 are held against vertical displacement relative to the legs of the tube bundle 8, in the usual way. Although the spacer grids are fixed against motion relative to the tube bundle legs, all stressing is avoided because each spacer grid can slide vertically and radially relative to the shroud 6. It is to be understood that because the tube bundle 8 carries the reactor coolant, while the shroud 6 is surrounded on both sides by the feed water, that the tube bundle reaches operating temperatures substantially higher than the operating temperature of the shourd 6, thus creating the problem solved by the present invention.

What is claimed is:

1. A steam generator having a tube sheet, a heat-exchanger tube bundle having ends mounted in said tube sheet and extending from said tube sheet, a cylindrical wall surrounding said tube bundle, at least one tube bundle tube spacer grid having a ring encircling said bundle inside of said cylindrical wall, and means for connecting said ring to said wall; wherein the improvement comprises said means being in the form of keys and keyways extending radially with respect to said ring and wall and relatively sliding longitudinally with respect to said tube bundle and wall when said ring and said wall thermally move relative to each other, while locking said ring non-rotatively relative to said wall.

2. The steam generator of claim 1 in which said keyways have bottoms and said keys have ends facing said bottoms, said bottoms and ends being interspaced a distance greater than the distance said ring and wall thermally move radially relative to each other during the normal operation of said steam generator.

3. The steam generator of claim 1 having at least three of said keys and keyways.

4. The steam generator of claim 1 in which said keys and keyways have rectangular cross sections.

* * * * *